US007085524B2

(12) United States Patent
Soda et al.

(10) Patent No.: US 7,085,524 B2
(45) Date of Patent: Aug. 1, 2006

(54) IMAGE FORMING APPARATUS

(75) Inventors: Takamitsu Soda, Shizuoka-ken (JP); Akihiko Takeuchi, Shizuoka-ken (JP); Tatsuya Kobayashi, Shizuoka-ken (JP); Naoki Enomoto, Ibaraki-ken (JP); Takehiko Suzuki, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 83 days.

(21) Appl. No.: 10/721,891

(22) Filed: Nov. 26, 2003

(65) Prior Publication Data

US 2004/0131396 A1 Jul. 8, 2004

(30) Foreign Application Priority Data

Nov. 29, 2002 (JP) ..... 2002-347108
Nov. 29, 2002 (JP) ..... 2002-347109

(51) Int. Cl.
*G03G 15/16* (2006.01)

(52) U.S. Cl. ..... 399/302; 399/101

(58) Field of Classification Search ..... 399/302, 399/299, 298, 308, 66, 303, 101
See application file for complete search history.

(56) References Cited

U.S. PATENT DOCUMENTS 5,032,852 A 7/1991 Fujii et al. ..... 347/118
5,066,979 A 11/1991 Goto et al. ..... 399/40
5,809,387 A 9/1998 Takeuchi et al. ..... 399/302
5,873,010 A 2/1999 Enomoto et al. ..... 399/39
5,940,654 A 8/1999 Uchiyama et al. ..... 399/49
5,970,278 A * 10/1999 Munakata ..... 399/101 X
6,091,913 A 7/2000 Suzuki et al. ..... 399/49
6,240,271 B1 * 5/2001 Shimazawa et al. ..... 399/299
6,324,358 B1 * 11/2001 Sahara ..... 399/66
6,418,294 B1 * 7/2002 Morikami et al. ..... 399/298
6,427,062 B1 7/2002 Takeuchi ..... 399/388
6,529,695 B1 * 3/2003 Katayanagi et al. .... 399/302 X
6,574,442 B1 6/2003 Kibune ..... 399/49
6,768,892 B1 * 7/2004 Sawai ..... 399/302
6,801,728 B1 * 10/2004 Taguchi et al. ..... 399/66
6,839,531 B1 * 1/2005 Saitoh et al. ..... 399/302 X
2003/0223785 A1 * 12/2003 Kanekura et al. ..... 399/299

FOREIGN PATENT DOCUMENTS

JP 2000-253223 A * 9/2000
JP 2001-343807 A * 12/2001

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes a plurality of movable image carriers, a movable intermediate transfer body, and a contacting member separably contacting to the intermediate transfer body at a contacting position. A position for transfer between a first image carrier and the intermediate transfer body defines a first transfer position. A position for transfer between a second image carrier and the intermediate transfer body defines a second transfer position. A toner image formed on said intermediate transfer body is again transferred onto a transfer material after passing through said first transfer position and said second transfer position. The latent image formation on the first image carrier is done at a time different from a contacting operation of the contacting member.

14 Claims, 10 Drawing Sheets

(a)

(b)

IMAGE FORMING APPARATUS

BACKGROUND OF THE INVENTION

1. Field of the Invention

This invention relates to an image forming apparatus such as a printer, photocopier, and a facsimile machine and, more particularly, to an apparatus utilizing an intermediate transfer body.

2. Description of Related Art

As an image forming apparatus of a full color electrophotographic type, an apparatus has been known to form full color images by sequentially forming plural toner images on a single photosensitive body and overlapping those toner images on an intermediate transfer body. More specifically, FIG. 10 illustrates the above structure. Respective toner images are sequentially formed upon sequentially facing developing units 4*a*, 4*b*, 4*c*, 4*d* having toners in different colors onto a first image carrier 1 as a sole photosensitive drum by means of a developing rotary apparatus 5. The respective color toner images are overlapped sequentially onto an intermediate transfer body 61 from the image carrier 1, and the toner images overlapped on the intermediate transfer body are transferred to a transfer material P by a secondary transfer roller 66. The transfer material carrying the toner images is fed through a fixing apparatus 8, thereby actually utilizing an image forming apparatus in which permanently fixed images are obtained in application of heat and pressure in the fixing apparatus. To form a full color image, image formation is made by overlapping four times the toner images on the intermediate transfer body where the toners in four colors are used.

The image forming apparatus above described does not have high productivity because the intermediate transfer body is required to be rotated the same times as the color number of the overlapped toners to overlap the toner images. Another image forming apparatus having plural photosensitive bodies, capable of overlapping the toner images in the prescribed number of colors on the intermediate transfer body where the intermediate transfer body is rotated twice has been known as an image forming apparatus improving the productivity but not rendering the apparatus itself significantly larger. This apparatus is called as a two-path system. In a case where, e.g., images overlapped with four color images are formed, such an image forming apparatus has two photosensitive bodies and forms a toner image overlapped with the four color toners upon rotating the intermediate transfer body two turns as, at every turn of the intermediate transfer body, the toner images of two colors are carried on the intermediate transfer body. That is, in this situation, there is an advantage to ensure a double productivity with respect to the image forming apparatus having a single photosensitive body.

However, the intermediate transfer body is required to be turned twice for image formation, and as a general rule it is necessary to escape members otherwise contacting to the toners on the intermediate transfer body so that the toner images on the intermediate transfer body are not disturbed between the transfer to the intermediate transfer body at the first turn and the transfer at the second turn. That is, in respect to the members contacting to the intermediate transfer body, attaching and detaching operations are needed during the image forming process, so that vibrations due to attaching and detaching operations may raise a problem rendering latent image formation disordered.

SUMMARY OF THE INVENTION

It is an object of the invention to provide an image forming apparatus preventing latent images from formed disorderly due to vibrations occurring when a member contacting to an intermediate transfer body is attached and detached. This invention,. particularly in an image forming apparatus equipped with a plurality of image carriers intending to improve the productivity, to solve the above problems without reducing the productivity.

In another object of the invention, an image forming apparatus is provided including: a plurality of movable image carriers, said image carriers forming latent images upon exposure at respective exposing positions to form a toner image at the latent images; a movable intermediate transfer body, to which the toner image is transferred from said image carriers, for carrying the toner image; and contacting member separably contacting to said intermediate transfer body at a contacting position, wherein said image carrier located most closely to said contacting position in a direction extending along said intermediate transfer body on a downstream side in a moving direction of said intermediate transfer body with respect to said contacting position, defines a first image carrier where a position for transfer between said first image carrier and said intermediate transfer body defines a primary transfer position, wherein said image carrier located most closely to said contacting position in a direction extending along said intermediate transfer body on an upstream side in a moving direction of said intermediate transfer body with respect to said contacting position, defines a second image carrier where a position for transfer between said second image carrier and said intermediate transfer body defines a second transfer position, wherein a toner image formed on said intermediate transfer body is again transferred onto a transfer material after passing through said primary transfer position and said second transfer position again, and wherein formula $La-Sa \geqq Lm$ is satisfied where a distance from said contacting position to said primary transfer position along the moving direction of said intermediate transfer body is set as La, where a distance from said exposing position on said first image carrier to said primary transfer position along the moving direction of said first image carrier is set as Sa, and where an image length formed on said intermediate transfer body is set as Lm. The latent image formation on the first image carrier is done at a time different from contacting operation of the contacting member.

In yet another object of the invention, an image forming apparatus is provided including: a plurality of movable image carriers, said image carriers forming latent images upon exposure at respective exposing positions to form a toner image at the latent images; a movable intermediate transfer body, to which the toner image is transferred from said image carriers, for carrying the toner image; and contacting member separably contacting to said intermediate transfer body at a contacting position, wherein said image carrier located most closely to said contacting position in a direction extending along said intermediate transfer body on a downstream side in a moving direction of said intermediate transfer body with respect to said contacting position, defines a first image carrier where a position for transfer between said first image carrier and said intermediate transfer body defines a primary transfer position, wherein said image carrier located most closely to said contacting position in a direction extending along said intermediate transfer body on an upstream side in a moving direction of said intermediate transfer body with respect to said contacting position, defines a second image carrier where a position for transfer between said second image carrier and said intermediate transfer body defines a second transfer position, wherein a toner image formed on said intermediate transfer body is again transferred onto a transfer material after passing through said primary transfer position and said second transfer position again, and wherein formula $Lb+Sb \geqq Lm$ is satisfied where a distance from said contacting position to said second transfer position along the moving route of said intermediate transfer body in a direction reverse to the moving direction of said intermediate transfer body is set as Lb, where a distance from said exposing position on said second image carrier to said second transfer position along the move of said second image carrier is set as Sb, and where an image length formed on said intermediate transfer body is set as Lm. The latent image formation on the second image carrier is done at a time different from contacting operation of the contacting member.

In still another object of the invention, an image forming apparatus is provided including: a plurality of movable image carriers, said image carriers forming latent images upon exposure at respective exposing positions to form a toner image at the latent images; a movable intermediate transfer body, to which the toner image is transferred from said image carriers, for carrying the toner image; and contacting member separably contacting to said intermediate transfer body, wherein said image carrier located on an upstream side in a moving direction of said intermediate transfer body, among said plural image carriers, defines a first image carrier, whereas said image carrier located on a downstream side of said first image carrier in the moving direction of said intermediate transfer body, defines a second image carrier where a position for transfer between said first image carrier and said intermediate transfer body defines a primary transfer position and where a position for transfer between said second image carrier and said intermediate transfer body defines a second transfer position, wherein a toner image formed on said intermediate transfer body is again transferred onto a transfer material after passing through said primary transfer position and said second transfer position again, wherein formula $Lc+Sa-Sb \geqq Lm$ is satisfied where a distance from said exposing position on said first image carrier to said primary transfer position along the moving direction of said first image carrier is set as Sa, where a distance from said exposing position on said second image carrier to said second transfer position along the moving direction of said second image carrier is set as Sb, where a distance from said primary transfer position to said second transfer position along the moving direction of the intermediate transfer body is set as Lc, and where an image length formed on said intermediate transfer body is set as Lm, and wherein latent image formation on said first image carrier, latent image formation on said second image carrier, and contacting operation of said contacting member are done at times different from each other.

Further objects of the invention will be apparent with the following explanation.

DETAILED DESCRIPTION OF THE RELATED EMBODIMENTS

Figure 1:
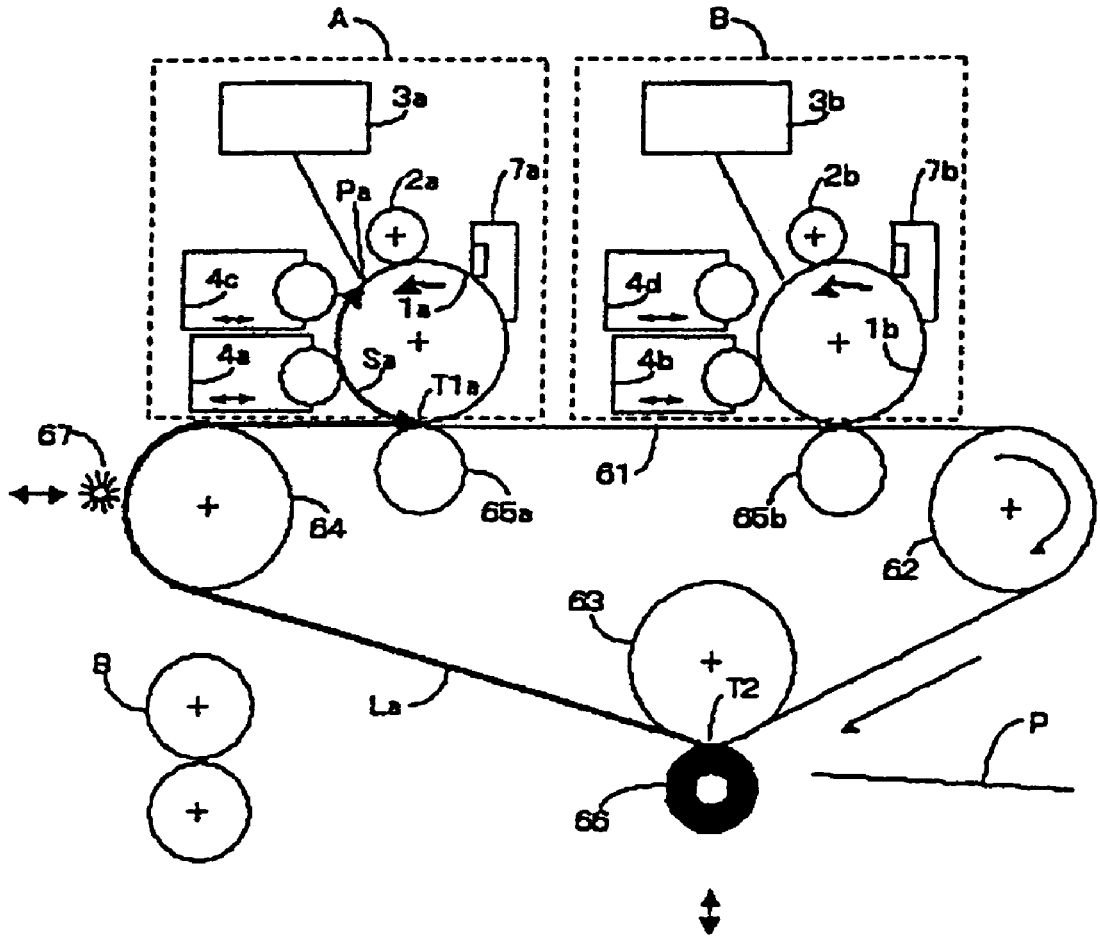
FIG. 1 is an illustration showing an image forming apparatus according to the first embodiment of the invention.

Hereinafter, referring to the drawings, embodiments of the invention are described.

[First Embodiment]

FIG. 1 is for a first embodiment of the invention. Hereinafter, it is dubbed in reference with the drawings.

An image forming apparatus is described below in which a first image forming portion and a second image forming portion are disposed around a movable endless image carrier, in which each image forming portion has at least two switchable developing apparatuses around an electrostatic latent image carrier, in which the two image forming portions do making latent images formed on electrostatic latent image carrier by exposure from an exposing apparatus to be toner images sequentially with the two developing apparatuses to transfer the toner images on the image carrier by a first transferring means, respectively, and in which the plural toner images formed on the image carriers am transferred at once on a recording material with a second transferring mean separably contacting to the image carrier.

Around an intermediate transfer belt 61 disposed are the first image forming portion A and the image forming portion B, each including a photosensitive drum, an exposing apparatus, a charging roller, the two switchable developing apparatuses, and a cleaning apparatus. Tension roller 64 imparts tension to the intermediate transfer belt 61.

In the image forming portion A, the photosensitive drum 1*a* is charged with the charging roller 2*a*, thereby rendering image exposure for yellow as a first color with the exposing apparatus 3*a*. The latent image formed on the photosensitive drum 1*a* is developed with the developing apparatus 4*a* corresponding to yellow as the first color. It is to be noted that the developing apparatuses 4*a*, 4*c* are movable in the arrow direction in the drawing by a driving means, not shown, which switches the developing apparatuses. The developed yellow toner images are transferred onto the intermediate transfer belt 61 by a primary transfer roller 65*a*.

The image forming portion B forms image of magenta as the second color as to match the position of the yellow toner image as the first color on the intermediate transfer belt 61. Image formation at the image forming portion B is done, in substantially the same way as in the yellow image formation as the first color at the image forming portion A described above, in which the photosensitive drum 1*b* is charged with the charging roller 2*b*, and in which an exposing apparatus 3*b* exposes images of magenta as the second color. The latent image formed on the photosensitive drum 1*b* are developed with the developing apparatus 4*b* corresponding to magenta as the second color. It is to be noted that the developing apparatuses 4*b*, 4*d* are movable in the arrow direction in the drawing by a driving means, not shown, which switches the developing apparatuses. The developed magenta toner images are transferred onto the intermediate transfer belt 61 by a primary transfer roller 65*b* as to match the position of the yellow toner image as the first color on the intermediate transfer belt 61.

In the image forming portion A, when development for yellow as the first color ends, the developing apparatus is switched to render the developing apparatus 4*c* for cyan as the third color come in contact with the photosensitive drum 1*a*. In the image forming portion B, when development for magenta as the second color ends, the developing apparatus is switched to render the developing apparatus 4*d* for black as the fourth color come in contact with the photosensitive drum 1*a*. A em tone image at the image forming portion A and a black toner image at the image forming portion B are formed as to match the toner images on the intermediate transfer belt 61 where the intermediate transfer bet 61 carrying the toner images of the first and second colors is turned one time to reach the image forming section, and are transferred onto the intermediate transfer belt 61 When the toner of the two colors are transferred onto the intermediate transfer belt 61 as to overlap on the toner images on the intermediate transfer belt 61 reaching again the image forming portion, a recording material P is conveyed in synchrony with the move of the intermediate transfer belt 61, and a secondary transfer roller 66, separated while the toner images are formed on the intermediate transfer belt 61, contacts with the intermediate transfer belt 61 via the recording material P, thereby transferring the four color toner images on the intermediate transfer belt 61 on the recording material P. The recording material P to which the four-color toner images are transferred a subject to melting and fixing at a fixing apparatus for known heating and pressure, thereby producing color images.

Transfer reining toner on the photosensitive drums 1*a*, 1*b* is cleaned up by cleaning apparatuses 7*a*, 7*b* as known blade means. Transfer remaining toner on the intermediate transfer belt 61 is also cleaned up by a far blush cleaning apparatus 67 separably contacting to the intermediate transfer belt 61.

As described above, the two-path method can complete a full color image only with two-turns of the intermediate transfer belt 61, so that the method can obtain the double recording rate in comparison with the four-path method in which a sole image forming portion is provided.

Timing that the secondary transfer roller 66, as a contacting member separably contacting during the process that four-color toner images are sequentially formed on the intermediate transfer belt 61 as an intermediate transfer body and transferred to the recording material P and as a means for transferring the toner images from the intermediate transfer belt to the transfer material, comes in contact with the intermediate transfer belt 61, is required to be after the rear end of the toner image of the first and second colors on the intermediate transfer belt 61 passes through a secondary transfer position T2 and before the front end of the four-color toner image on the intermediate transfer belt 61 reaches the secondary transfer position T2. This is because if the contact is made before the rear end of the toner image of the first and second colors passes through the secondary transfer position T2 the rear end of the toner image may be attached to the secondary transfer roller 66 and because if the contact is made after the front end of the four-color toner images passes through the secondary transfer position T2 the front end of the four color toner image may not be transferred properly on a recording material. In a meanwhile, mechanical vibrations may occur at a time that the secondary transfer roller 66 contacts, and the vibrations may be transmitted to the exposing apparatuses 3*a*, 3*b* and the photosensitive drums 1*a*, 1*b*, thereby generating so-called exposure blurs. Such exposure blurs may become strips extending horizontally on an actual image and thereby reduce image quality. It is very difficult to prevent exposure blur from occurring completely even where the apparatus body, the photosensitive drum, and the exposing apparatus are made with high rigidity.

In this embodiment, the exposure blur is avoided by rendering a distance Sa (hereinafter referred to as "the distance between Pa and T1*a*") in a rotational direction of the photosensitive drum (first image carrier) from the exposing position Pa to the primary transfer position (primary transfer position) T1*a* on the photosensitive drum 1*a* in the first image forming portion A, a distance La (hereinafter referred to as "the distance between T2 and T1*a*") in a moving direction of the intermediate transfer belt 61 to a primary transfer position T1*a* of the first image forming portion A, and a length Lm of image (hereinafter referred to as "image length") to be formed on a recording medium, satisfy the relation $La-Sa \geqq Lm$ [Formula 1].

Where Formula 1 is satisfied, the secondary transfer roller 66 can be made contacting to the intermediate transfer belt 61 after the rear end of the toner image of the first and second colors on the intermediate transfer belt 61 passes through the secondary transfer position T2 and before start of exposing operation of the third color in the first image forming portion A. That is, during the exposing operation, the secondary transfer roller 66 does not perform attaching operation. It is to be noted that in regard with reaching of the front end of the four-color toner image to the secondary transfer position Formula 1 is adequately satisfactory because it is after the start of exposure of the third color.

Here, the image length Lm is described. If the image length Lm of the maximum length that can be recorded at the apparatus satisfies Formula 1, the image having a shorter length than the image of the maximum length inevitably satisfies Formula 1, thereby not generating any exposure blur. Where the maximum image length that can be recorded at the apparatus is set to be the image length Lm satisfying Formula 1, this apparatus can correspond to images in all size.

The image forming apparatus are generally designed as to use recording media in regular sizes according to the JIS or the like standard as the recording media most frequently used hereinafter referred to as "most frequently used recording medium"). Those are categorized specifically into, e.g., two types, A4 size (length 297 mm) and A3 size (length 420 mm). Accordingly, in an image forming apparatus corresponding to the A4 size, Lm is set to 297 mm, whereas in an image forming apparatus corresponding to the A3 size, Lm is set to 420 mm, and Sa, La are set as satisfying Formula 1 in reference with those lengths.

There is, however, a case that the apparatus can be designed to be recording an image longer than the most frequently used recording medium. For example, such a case is for legal size (length 356 mm) in an image forming apparatus corresponding to A4 size. In such a case, Lm is set to 356 mm to render the apparatus correspond to the legal size, but as Lm is larger, Sa and La satisfying Formula 1 become larger. This means that the diameter of the photosensitive drum 1 and the peripheral length of the intermediate transfer belt 61 become larger, and as a result, the whole of the apparatus likely becomes larger.

To solve this problem, for response to images in size larger than the image length Lm satisfying Formula 1, exposure blurs may be avoided from doing contact of the secondary transfer roller 66 after the intermediate transfer belt 61 is further rotated for one turn, or namely after the rear end of the four-color toner image passes through the secondary transfer position T2, because latent image formation of the third color already begins when the rear end of the toner images of the first and second colors passes through the secondary transfer position T2. This can suppress the rotation of the intermediate transfer belt 61 required for recording per one sheet up to three turns even where continuous recording is made with images not satisfying Formula 1, so that this apparatus can suppress longer recording time taken for recording images as well as preventing itself from being made lager.

As described above, according to this embodiment, the relation among the distance Sa between Pa and T1*a*, the distance La between T2–T1*a*, and the image length Lm, is set to be Sa≦La−Lm, so that exposure blurs at the image forming portion due to contact shocks at the secondary transfer roller 66 can be prevented without reducing the recording rate.

[Second Embodiment]

Figure 2:
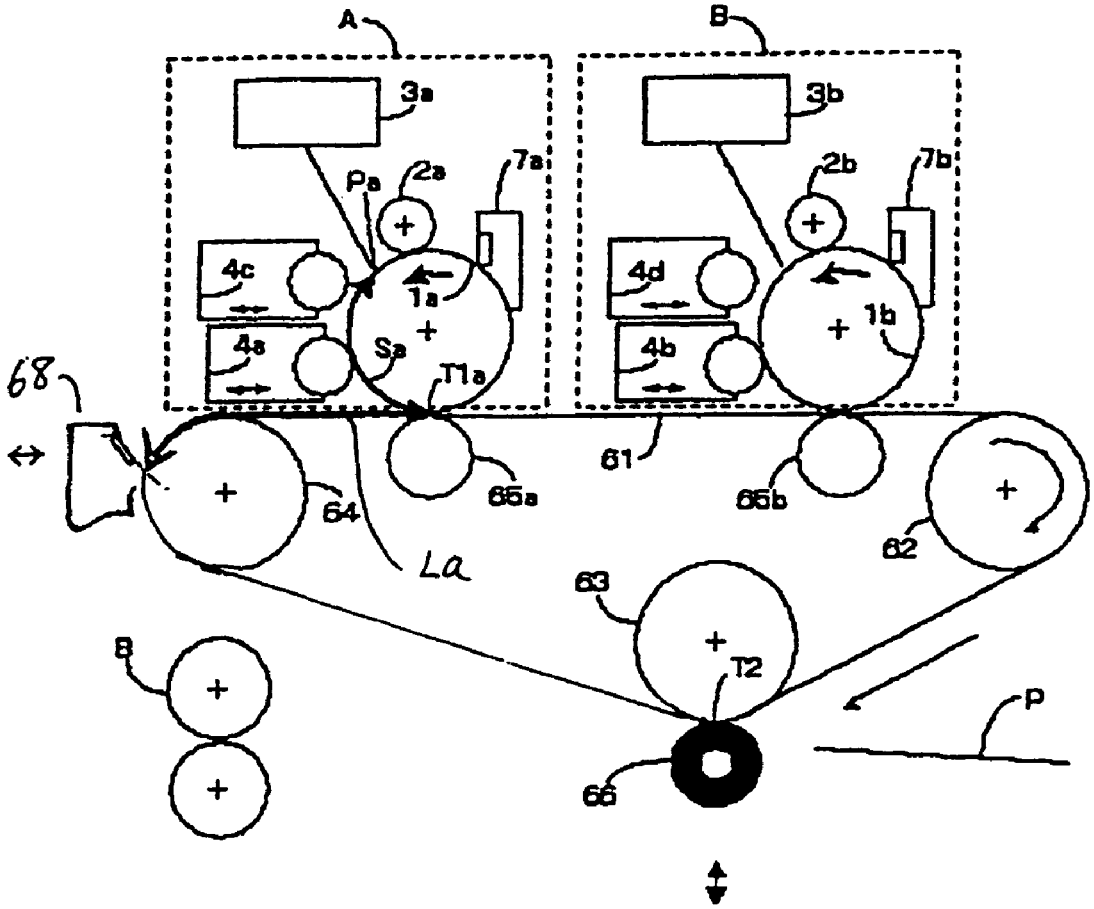
FIG. 2 is an illustration showing an image forming apparatus according to the second embodiment of the invention.

FIG. 2 is for the second embodiment of the invention. Members having the same structure and function as those in the first embodiment as described above are assigned with the same reference numbers, respectively, as a description is omitted. First embodiment is of a system adapting a fur blushing mechanism as a detachable cleaning means on the intermediate transfer belt 61. The fur blush does cleaning function adequately even where pressing force to the intermediate transfer belt 61 is small, and is workable without generating vibrations such that the latent image formation is greatly affected. In this embodiment, the cleaning means 68 contacting to the intermediate transfer belt 61 adapts a member utilizing a cleaning blade 68*a*. The cleaning blade 68*a* is for cleaning upon stagnating the secondary transfer remaining toner on the intermediate transfer belt 61, and the contact force is set 1000 gf, thereby surely functioning cleaning effects. This cleaning blade 68*a* functions as not to disorder the toner, on the intermediate transfer belt 61, going away from the intermediate transfer belt 61 and passing through the transfer position again, and cleans the transfer remaining toner on the intermediate transfer belt 61 upon contacting to the intermediate transfer belt 61. That is, it is a contacting member capable of isolating moving. Furthermore, the cleaning blade 68*a* may generate vibrations such that latent image formation is greatly affected during contact operation caused by strong contact force.

Therefore, in this embodiment, the cleaning blade 68*a* does not move to contact during exposure operation necessary for image formation of the third color. That is, although images are prevented from being deteriorated upon setting the same condition as in the first embodiment, the cleaning blade 68*a* is "a contacting member" in this embodiment whereas "the contacting member" is the secondary transfer roller 66 in the first embodiment. Exposure blurs described above are avoided upon setting the following relation in the same as in the first embodiment where the distance in the moving direction of the intermediate transfer belt 61 from the contact position of the cleaning blade 68*a* on the intermediate transfer belt 61 to the primary transfer position T1*a* of the first image forming portion A is set as La, $$La-Sa \geqq Lm \qquad \text{[Formula 1]}$$

[Third Embodiment]

Figure 3:
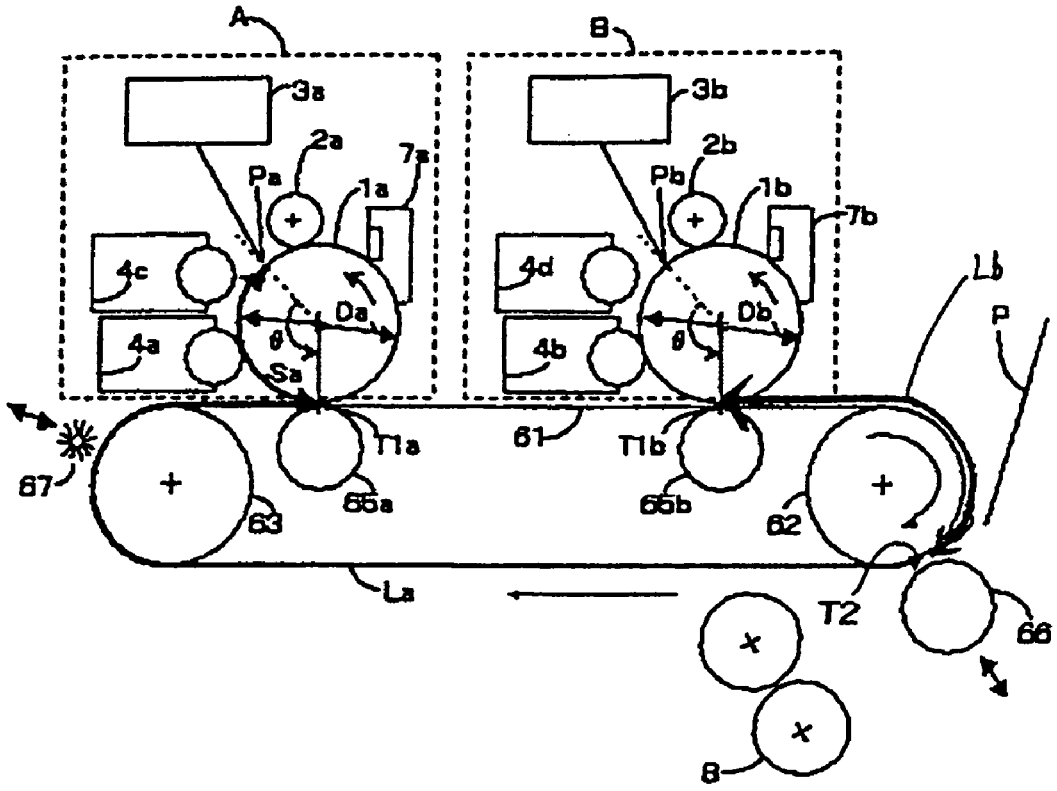
FIG. 3 is an illustration showing an image forming apparatus according to the third embodiment of the invention.

FIG. 3 is for the third embodiment of the invention. Members having the same structure and function as those in the first embodiment as described above are assigned with the same reference numbers, respectively, and a description is omitted. In this embodiment, exposure blurs due to contacting shocks from the secondary transfer roller 66 are avoided, and the apparatus is made with a smaller size and reduced costs.

In this embodiment, the exposure blurs due to contacting shocks from the secondary transfer roller 66 are avoided by rendering, in substantially the same way as in the first embodiment, a distance Sa in the rotational direction of the photosensitive drum 1*a* from the exposing position Pa to the primary transfer position T1*a* on the photosensitive drum 1*a* in the first image forming portion A, a distance La in the moving direction of the intermediate transfer belt 61 from a secondary transfer position T2 on the intermediate transfer belt 61 to a primary transfer position T1*a* of the first image forming portion A, and a length Lm of image to be formed on a recording medium, satisfy the relation above Formula 1.

In a case considering cost reduction of the apparatus, it is desirable to design the diameters Da, Db of the photosensitive drums 1*a*, 1*b* in the image forming portions A, B to be the same because preparation of two types of the photosensitive drums is not required. Although an exposing apparatus, a charging roller, two developing apparatuses, and a cleaning apparatus are to be disposed around the photosensitive drum, those members can have the same structures, respectively, upon rendering the photosensitive drums with the same diameter to each other, so that further cost reduction is possible. Where the photosensitive drum having the same diameter is used, the potential of the exposure portion of the photosensitive drum can be equalized, so that density and grayscale can be equalized, as desirable to the extent of image quality.

In a meanwhile, from a viewpoint to a compact size of the apparatus, the diameter of the photosensitive drum is important, and it is more advantageous for reduction of the apparatus size as the diameter is smaller, but the arrangement of the members to be disposed peripherally faces hardship as described above. The arrangement of the peripheral members can be made easier as the diameter is larger, but the apparatus becomes larger. In consideration of both, the diameters Da, Db of the photosensitive drums 1*a*, 1*b* are desirably not less than 24 mm and not more than 60 mm.

Next, the exposing positions Pa, Pb are described. The positions are almost decided form the members disposed around the photosensitive drum, and an angle é between the exposing position Pa and the primary transfer position T1*a* with respect to the center of the photosensitive drum 1*a* is generally 120 to 240 degrees.

Accordingly, the distance Sa between Pa–T1*a* is about 25 mm to 126 mm in consideration of the photosensitive drum diameters Da, Db, and the angle θ (this is substantially the same to the second image forming portion B, the description is omitted).

Where the image length Lm is set as 300 mm as corresponding to the A4 size, Formula 1 described above is expressed as follows:

In a case where $Sa=25$, $25 \leqq La-300$ therefore, $La \geqq 325$ mm [Formula 1a]

In a case where $Sa=126$, $126 \leqq La-300$ therefore, $La \geqq 426$ mm [Formula 1b]

Figure 4:
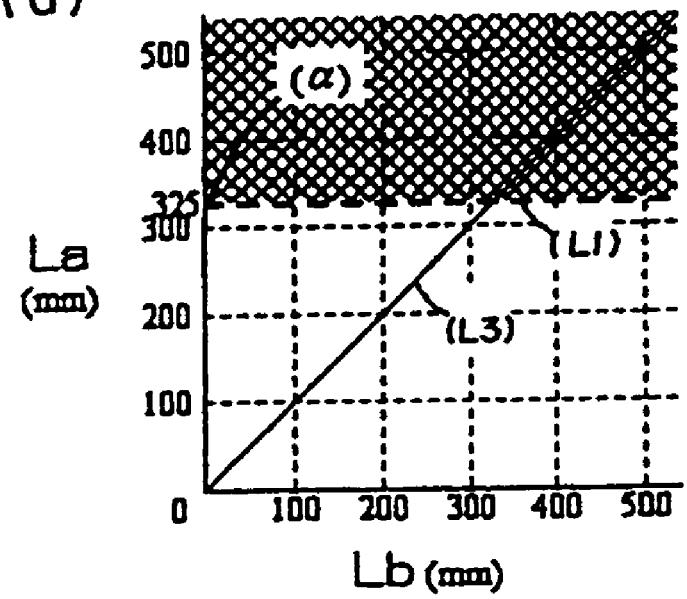
FIG. 4 is a relationship diagram of a length of an intermediate transfer belt in the image forming apparatus according to the third embodiment of the invention.
Figure 4:
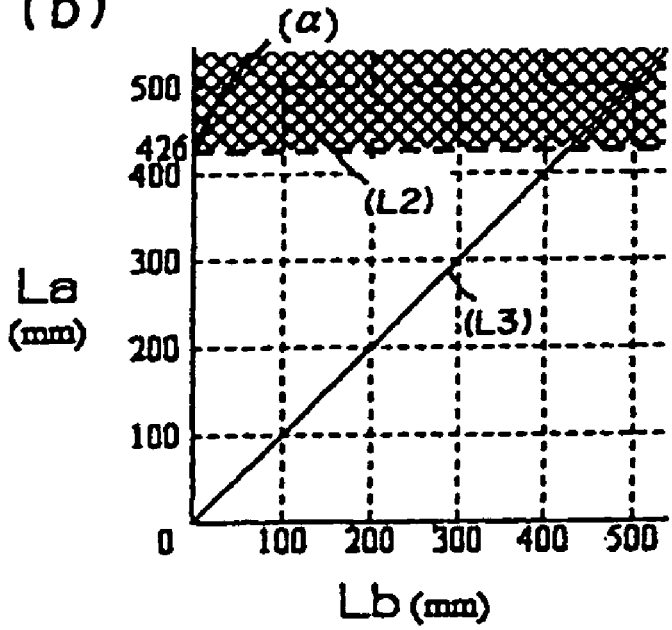

The relation of a distance Lb (hereinafter referred to as "distance between T1*b* and T2") in the moving direction of the intermediate transfer belt 61 from a primary transfer position T1*b* of the second image forming portion B to the secondary transfer position T2 on the intermediate transfer belt 61 and the distance La between T2 and T1*a*, is shown in FIG. 4(*a*) with respect to Formula 1a and in FIG. 4(*b*) with respect to Formula 1b. The abscissa of the graph indicates distance Lb, and the ordinate indicates distance La. The line denoted with L1 in the drawings indicates a situation that Formula 1a is of a case of "equal"; the line denoted with L2 in the drawings indicates a situation that Formula 1b is of a case of "equal"; the line denoted with L3 indicates a situation that Lb=La. That is, Formula 1a and Formula 1b indicate a region on an upper side of the liens denoted with L1, L2 in the drawings.

The scope of Formula 1a and Formula 1b is indicated with hatching in the drawings. In use of La and Lb in the hatching region, exposure blurs due to shocks of the secondary transfer roller 66 can be avoided.

The point shown with α is a point at which La+Lb become minimum. In fact, the first transfer point T1b of the second image forming portion B never coincides to the secondary transfer position T2, so that Lb cannot be zero. However, if a point close to α in the drawing chosen, La+Lb become smaller, and thereby the apparatus can be made compact.

As apparent from the drawings, in any case of FIG. 4(*a*), 4(*b*), at a region on an upper side of the line shown with L3, or namely the region of La>Lb, La+Lb become smaller as coming closer to the point á. In a case where La<Lb, because it is in the hatching region and the region on the right side with respect to the line of L3, La+Lb become a larger value, and this means that the length of the intermediate transfer belt 61 becomes longer, so that the apparatus may become larger.

In this embodiment, it is set that La>Lb, or namely, the contact position T2 of the secondary transfer roller 66 is disposed near the primary transfer position T1*b* of the second image forming portion B with respect to the primary transfer position T1*a* of the first image forming portion A. Hereinafter, it is described with reference to FIG. 2. In this embodiment, the intermediate transfer belt 61 is tensioned with two rollers 62, 63 as the minimum to provide a compacter apparatus. The formula La>Lb is made by rendering the secondary transfer roller 66 to be structured as to separably contact with the roller 62 located near the second image forming portion B.

It is to be noted that as in the first embodiment described above, in a case where the intermediate transfer belt 61 is tensioned with three rollers 62, 63, and 64, Formula La>Lb may be used by disposing the roller facing to the secondary transfer roller 66 nearer to the second image forming portion B than the first image forming portion B.

As described above, according to this embodiment, in addition to the first embodiment, the diameters of the photosensitive drums 1*a*, 1*b* in the first image forming portion A and the second image forming portion B are the same and in a range of 24 mm to 60 mm, and the relation of the distance between T1*b* and Ts and the distance between T2 and T1*a* is set as La>Lb, so that the apparatus can be provided with a compacter side and more reduced costs, in addition to the advantages in the first embodiment.

It is to be noted that in the embodiment described above, as the apparatus satisfying Formula 1, exemplified is an apparatus with image length of Lm corresponding to A4 size, but this invention is not limited to this. The apparatus can be corresponding to, e.g., A3 size, and in such a case the length Lm is set equal to 420 mm. As the size Lm of those, the image length Lm in the moving direction of the recording material is desirably selected from one of most frequently used images in the image forming apparatus, and it is desirable to ensure the high image quality for images frequently used while realizing compact size and high productivity.

[Fourth Embodiment]

Figure 5:
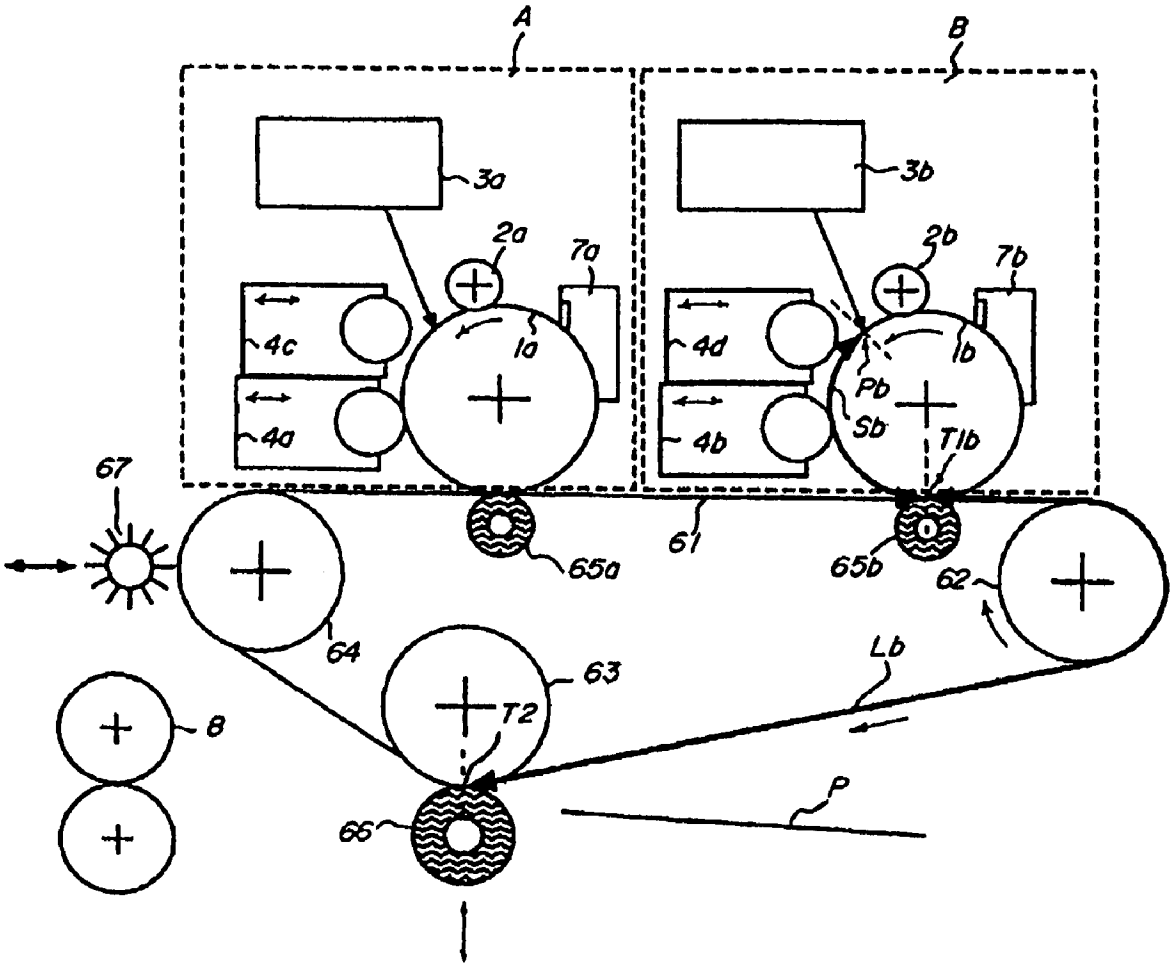
FIG. 5 is an illustration showing an image forming apparatus according to the fourth embodiment of the invention.

In the first to third embodiments, described are mechanisms in which the secondary transfer roller 66 does contacting operation before image exposure of the third color. In this embodiment, set forth is a structure in which vibrations from contacting operation of the secondary transfer roller 66 does not affect the latent image formation by performing secondary transfer operation after latent image formation of the fourth color. The structure for this purpose is as follows. Referring to FIG. 5, it is described.

Four-color toner images arm formed on the intermediate transfer belt 61 as an image carrier, and the timing that the secondary transfer roller 66 as a separably contactable second transfer means contacts to the intermediate transfer belt 61 is prior to the timing that the front end of the toner image on the intermediate transfer belt 61 reaches the secondary transfer position T2. This is because the front end of the toner He may not be transferred properly on the recording material if contact is made after the front end of the toner Age passes through the secondary transfer position T2.

In a meanwhile, at a moment that the secondary traveler roller 66 contacts, mechanical vibrations may occur, and such vibrations may reach the expose apparatuses 3*a*, 3*b* and the photosensitive dams 1*a*, 1*b* as the electrostatic latent image carriers, thereby generating so-called exposure blurs.

In this embodiment, the exposure blurs described above can be avoided by rendering a distance Sb (hereinafter referred to as "the distance between Pb and T1*b*") in a rotational direction of the photosensitive drum 1*b* from the exposing position Pb to the primary transfer position T1*b* on the photosensitive drum 1*b* in the second image forming portion B, a distance Lb (hereinafter referred to as "the distance between T1*b* and T2") in a moving direction of the intermediate transfer belt 61 from a primary transfer position T1*b* (second transfer position) to a secondary transfer position T2 on the intermediate transfer belt 61 of the second image forming portion B, and a length Lm of image to be formed on a recording medium, satisfy the relation Sb +Lb≧Lm [Formula 2].

Where Formula 2 is satisfied, the secondary transfer roller 66 can be made contacting to the intermediate transfer belt 61 before the toner image on the intermediate transfer belt 61 reaches the secondary transfer position T2 and after exposure at the second image forming portion B ends. It is to be noted that in regard with exposure in the first image forming portion A Formula 2 is adequately satisfactory because the first image forming portion A is located on an upper side in the moving direction of the intermediate transfer belt 61 with respect to the second image forming portion B, and because the exposure completion is earlier than the second image forming portion B.

Here, the image length Lm is described. If the image length Lm of the maximum length that can be recorded at the apparatus satisfies Formula 2, the image having a shorter length than the image of the maximum length inevitably satisfies Formula 2, thereby not generating any exposure blur. Where the maximum image length that can be recorded at the apparatus is set to be the image length Lm satisfying Formula 2, this apparatus can correspond to images in all size, as the same manner in the above embodiments.

[Fifth Embodiment]

Figure 6:
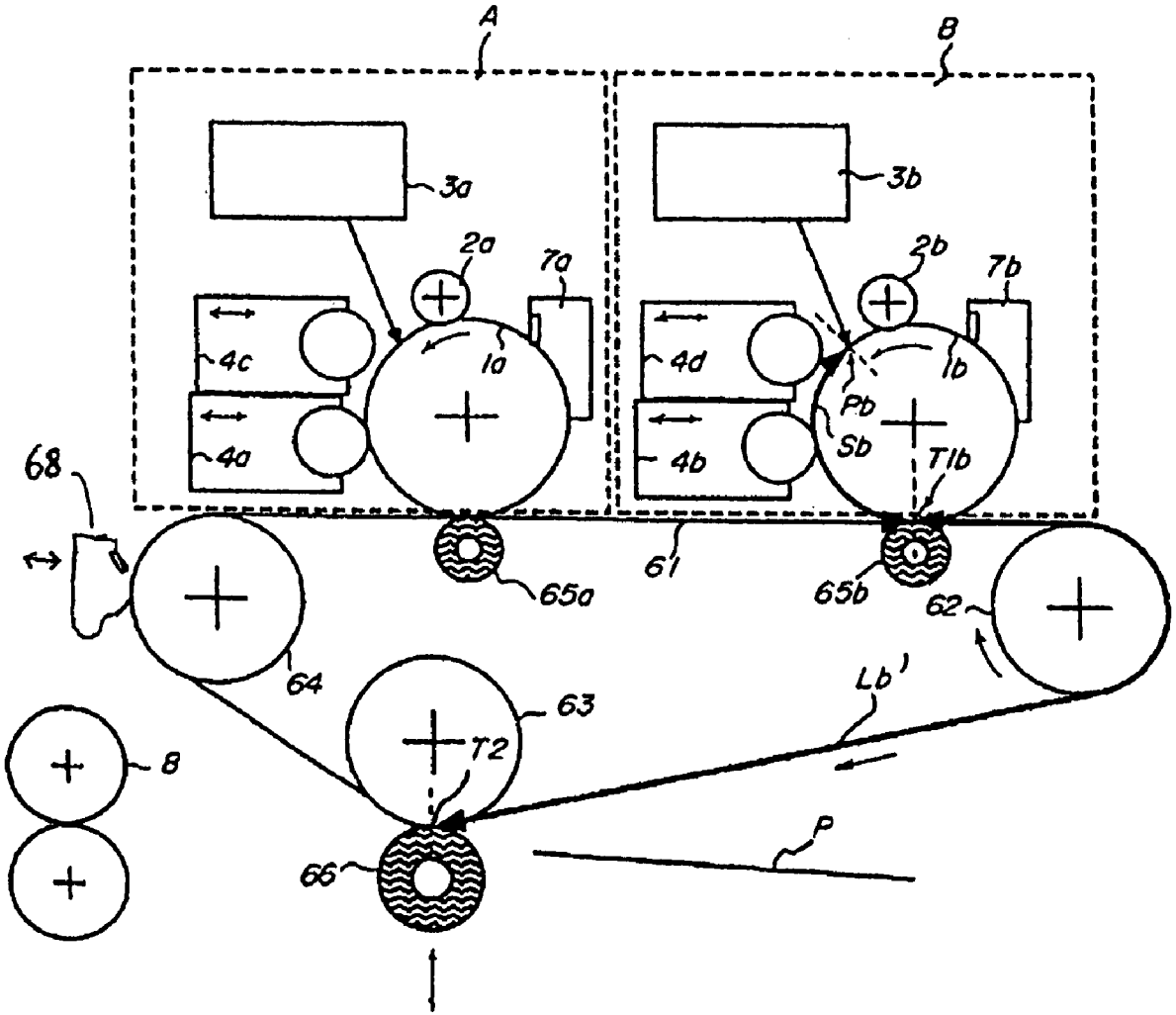
FIG. 6 is an illustration showing an image forming apparatus according to the fifth embodiment of the invention.

FIG. 6 is for the fifth embodiment of the invention. Members having the same structure and function as those in the fourth embodiments as described above are assigned with the same reference numbers, respectively, and a description is omitted. The fourth embodiment is of a system adapting a fur blushing mechanism as a detachable cleaning means on the intermediate transfer belt 61. The fur blush does cleaning function adequately even where pressing force to the intermediate transfer belt 61 is small, and is workable without generating vibrations such that the latent image formation is greatly affected. In this fifth embodiment, the cleaning means 68 contacting to the intermediate transfer belt 61 adapts a member utilizing a cleaning blade 68*a*. The cleaning blade 68*a* is for cleaning upon stagnating the secondary transfer remaining toner on the intermediate transfer belt 61, and the contact force is set as 1000 gf, thereby surely functioning cleaning effects. This cleaning blade 68*a* functions as not to disorder the toner, on the intermediate transfer belt 61, going away from the intermediate transfer belt 61 and passing through the transfer position again, and cleans the transfer remaining toner on the intermediate transfer belt 61 upon contacting to the intermediate transfer belt 61. That is, it is a contacting member capable of isolating moving. Furthermore, the cleaning blade 68*a* may generate vibrations such that latent image formation is greatly affected during contact operation cause by strong contact force.

Therefore, in this embodiment, the cleaning blade 68*a* does not move to contact during exposure operation necessary for image formation of the fourth color. That is, although images are prevented form being deteriorated upon setting the same condition as in the fourth embodiment, the cleaning blade 68*a* is "a contacting member" in this embodiment whereas "the contacting member" is the secondary transfer roller 66 in the fourth embodiment. That is, adverse influence due to vibrations of the cleaning blade 68*a* serving as the cleaning means can be avoided upon where the requirements as set forth in the fourth embodiment are satisfied and where the following relation is further satisfied. Exposure blurs described above are avoided upon setting the following relation in the same as in the fourth embodiment where the distance in the moving direction of the intermediate transfer belt 61 from the primary transfer position T1*b* to the secondary transfer position T2 in the second image forming portion B on the intermediate transfer belt 61 is set as Lb', $$Sb+Lb' \geqq Lm \qquad \text{[Formula 2]}$$

It is to be noted that in this structure, if satisfying the condition of the fourth embodiment, the cleaning blade 68*a* is satisfactory by contacting to the intermediate transfer belt 61 at the same time as or immediately after the secondary transfer roller 66 contacts to the intermediate transfer belt 61.

[Sixth Embodiment]

Figure 7:
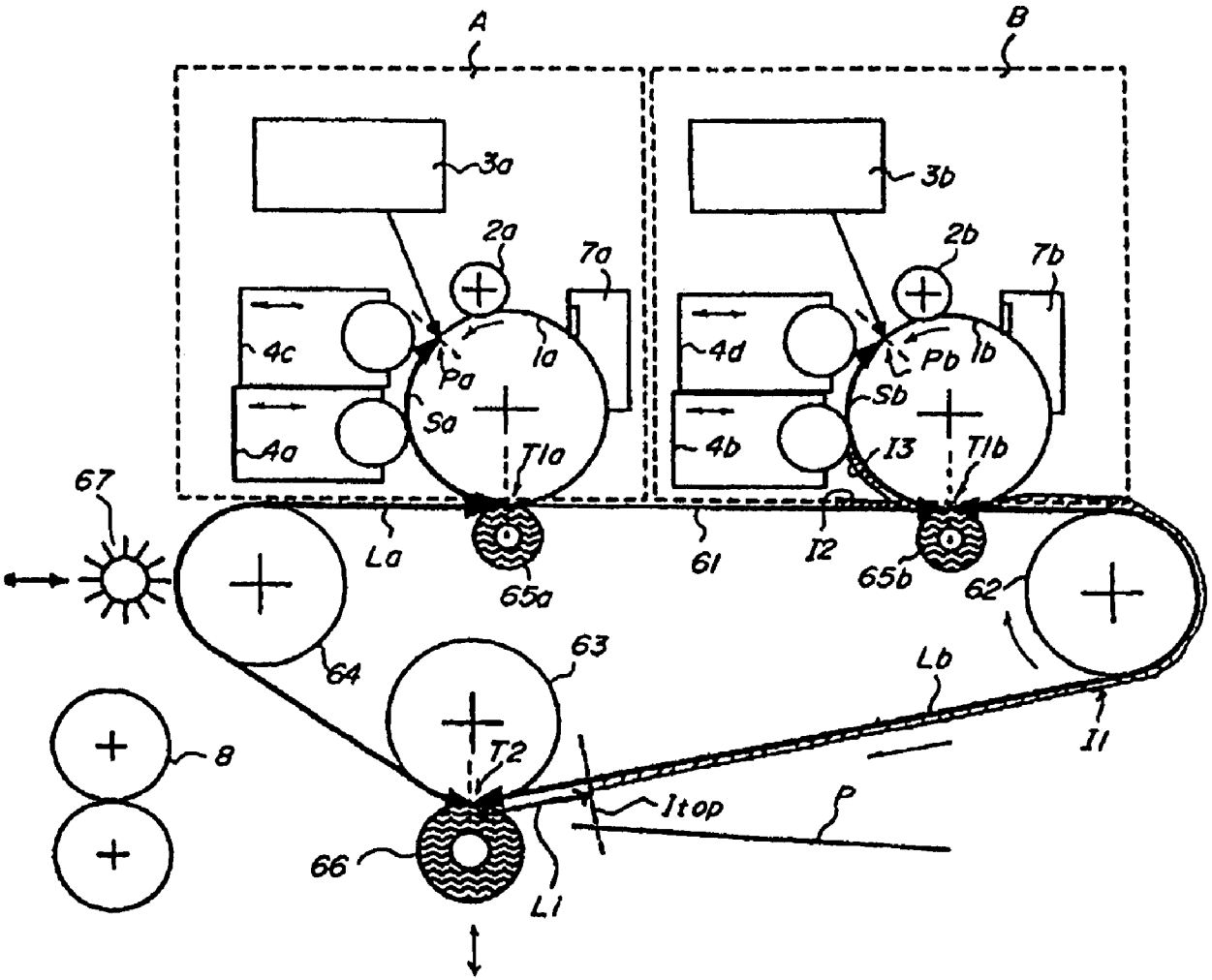
FIG. 7 is an illustration showing an image forming apparatus according to the sixth embodiment of the invention.

FIG. 7 is for the sixth embodiment of the invention. Members having the same structure and function as those in the first embodiment as described above are assigned with the same reference numbers, respectively, and a description is omitted. This embodiment relates to a method avoiding exposure blurs at the image forming portion A due to contact shocks with the secondary transfer roller 66. In regard with exposure blurs at the first image forming portion A, such blurs occur at the second sheet or later when plural sheets are printed successively. That is, the contact shocks by the secondary transfer roller 66 when the apparatus performs the secondary transfer step for the first sheet generate exposure blur of the first color at the second sheet done in the first image forming portion A.

To avoid this problem, the exposure of the first color at the second sheet is started after the secondary transfer roller 66 contacts. In this embodiment, the exposure blurs described above are avoided by rendering a distance Sa in the rotational direction of the photosensitive drum 1*a* from the exposing position Pa to the primary transfer position T1*a* on the photosensitive drum 1*a* in the first image forming portion A a distance La in the moving direction of the intermediate transfer belt 61 from a secondary transfer position T2 on the intermediate transfer belt 61 to a primary transfer position T1*a* of the first image forming portion A, a distance Sb between Pb and T1*b* and a distance Lb between T1*b* and T2 in the second image forming portion B, and the image length Lm, satisfy the following relation, $$Sb+Lb-Lm+La \geqq Sa \qquad \text{[Formula 3]}$$

FIG. 7 shows a movement when the secondary transfer roller 66 for performing the secondary transfer for the first sheet comes in contact with the intermediate transfer belt 61. The portion I1 and I3 shown with hatching are regions relating to toner images of the first sheet on the intermediate transfer belt 61. The toner image I1 on the intermediate transfer belt 61 on a downstream side in the rotational direction of the intermediate transfer belt 61 with respect to the primary transfer position T1*b* of the image forming portion B is a toner image in which toner images of four colors are overlapped; the toner image I2 on the intermediate transfer belt 61 on an upstream side in the rotational direction of the intermediate transfer belt 61 with respect to the primary transfer position T1*b* of the image forming portion B is a three-color toner image of first to three colors; the toner image I3 on the photosensitive drum 1*b* is a toner image of the fourth color. The front end position of the toner image sometimes simply referred to as "I" on the intermediate transfer belt 61 is set as Itop. A distance from the position Itop to the secondary transfer position T2 is set as Li.

As described in the above embodiment, to prevent exposure blurs from occurring at the second image forming portion B, the distances Sb, Lb, and Lm are in a relation satisfying Formula 2, and contacting of the secondary transfer roller 66 to the intermediate transfer belt 61 is done before the image front end Itop reaches the secondary transfer position T2 and after the exposure for the fourth color ends. Therefore, the distance described above Li is as follows.

$$0 \leqq Li \leqq Sb+Lb-Lm \qquad \text{[Formula 3]}$$

Next, image formation of the first color for the second sheet is described. Because the toner image of the second sheet is also formed at the same position on the intermediate transfer belt 61, the image front end on the intermediate transfer belt 61 is at the position of Itop. As described above, to avoid contacting shocks of the secondary transfer roller 66 at the first image forming portion A, exposure by the exposing apparatus 3*a* is started after the secondary transfer roller 66 comes in contact. In such a case, to match the image front end to the position of Itop, it is required that Li+La≧Sa. That is, according to Formula 1 and Formula 3, $$Sb+Lb-Lm+La \geqq Sa \quad \text{[Formula 4]}$$

Therefore, if Formula 4 is satisfied, the contact timing of the secondary transfer roller 66 can be done at a timing different from the exposure, and if images are successively formed, images can be obtained without any adverse influence due to irregularity on latent images on the first image carrier and without any adverse influence due to irregularity on latent images on the second image carrier in any of images of the first sheet image and the second sheet image.

In a case that Sb+Lb−Lm+La≦Sa, if exposure blur is avoided, the image front end of the second sheet is located on a downstream side in the rotational direction of the intermediate transfer belt 61 with respect to Itop. Therefore, in such a case, during successive recording, the position of Itop is shifted by a prescribed amount in a downstream direction of the intermediate transfer belt 61 at each recording sheet, thereby avoiding exposure blurs due to contacting shocks of the secondary transfer roller 66. However, when successive recording is made, this means that the rotation of the intermediate transfer belt 61 required for recording of one sheet takes two turns or more, and the recording rate becomes slower by that portion.

As described above, according to this embodiment, in addition to the first embodiment as described above, the relation among the distance Sa between Pa and T1*a*, the distance La between T2 and T1*a*, the distance Sb between Pb and T1*b*, the distance Lb between T1*b* and T2, and the image length Lm is set as Sb+Lb−Lm+La≧Sa, thereby preventing exposure blurs from occurring in the first image forming portion due to contacting shocks of the secondary transfer roller 66 at the second sheet or later during the successive recording without reducing the recording rate in addition to the advantages of the first embodiment.

In a case that Sb+Lb−Lm+La<Sa, exposure blurs on the first image carrier due to contacting shocks of the secondary transfer roller 66 can be prevented by forming toner images on the intermediate transfer belt 61 on the downstream side in the moving direction of the belt at each recording sheet when recording is made successively, though the recording rate can be slightly slower.

[Seventh Embodiment]

Figure 8:
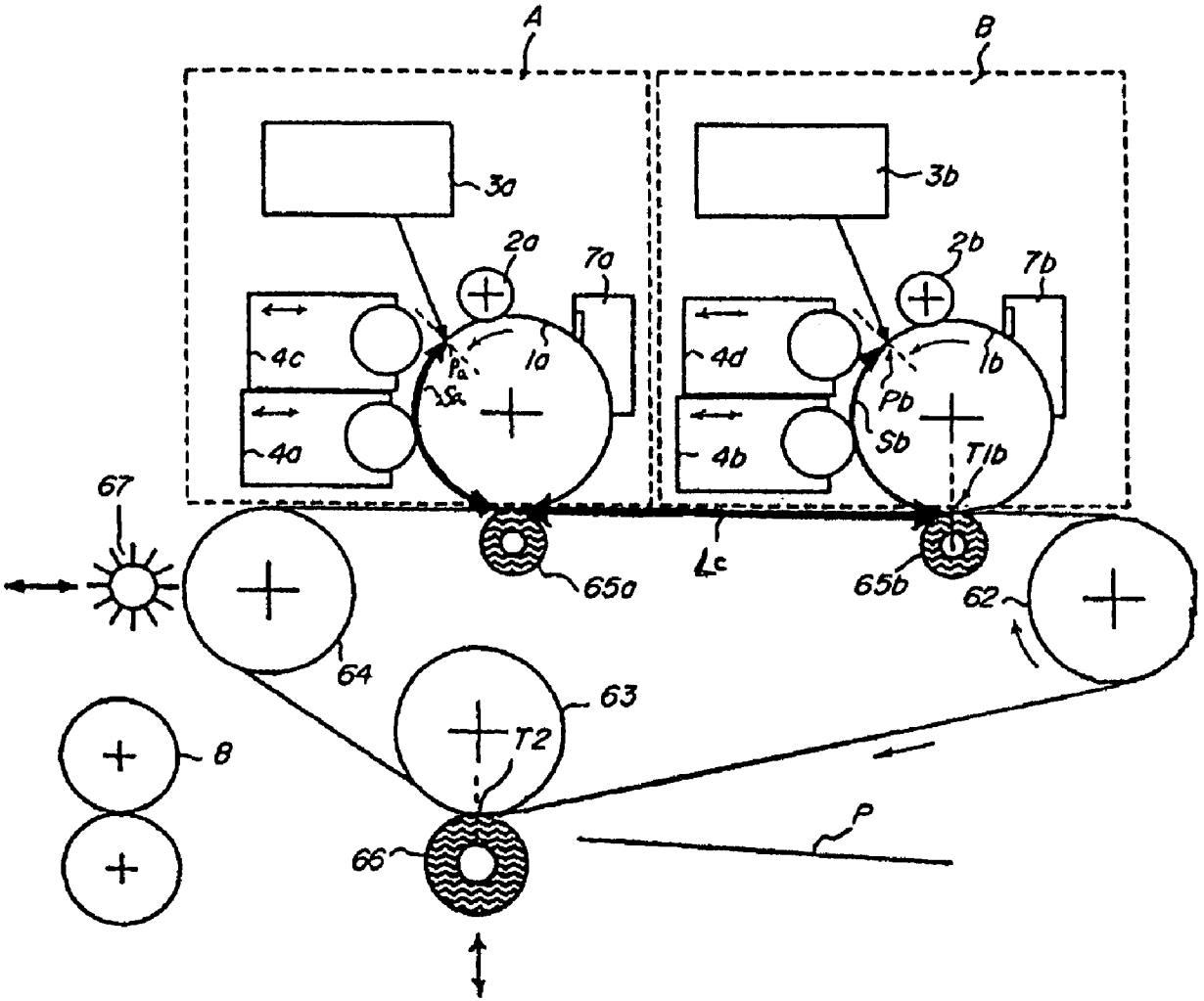
FIG. 8 is an illustration showing an image forming apparatus according to the seventh embodiment of the invention.

FIG. 8 is for the seventh embodiment of the invention. Members having the same structure and function as those in the first embodiment as described above are assigned with the same reference numbers, respectively and a description is omitted. This embodiment is effective particularly in a case that a distance between contacting positions of the intermediate transfer body and the image carrier is ensured to some extent Timing that the secondary transfer roller 66, as a contacting means separably contacting during the process that four-color toner images are sequentially formed on the intermediate transfer belt 61 as an intermediate transfer body and transferred to the recording material P and as a means for transferring the toner images from the intermediate transfer belt to the transfer material, comes in contact with the intermediate transfer belt 61, is required to be at a time that the rear end of the latent image corresponding to the toner image of the third color on the intermediate transfer belt 61 exceeds the position of Pa, or namely that the latent image formation on the image carrier ends, and further, before the latent image formation corresponding to the toner image of the fourth color on the intermediate transfer belt 61 starts. In the same manner as in the embodiments above, this apparatus can prevent so-called exposure blurs from occurring upon that mechanical vibrations occur at a time that the secondary transfer roller 66 contacts, and the vibrations are transmitted to the exposing apparatuses 3*a*, 3*b* and the photosensitive drums 1*a*, 1*b*.

In this embodiment, the exposure blurs described above are avoided by rendering a distance Sa (hereinafter referred to as "the distance between Pa and T1*a*") in a rotational direction of the photosensitive drum 1*a* (first image carrier) from the exposing position Pa to the primary transfer position (primary transfer position) T1*a* on the photosensitive drum 1*a* in the first image forming portion A, a distance Sb (hereinafter referred to as "the distance between Pb and T1*b*") in a rotational direction of the photosensitive drum 1*b* (first image carrier) from the exposing position Pb to the primary transfer position (primary transfer position) T1*b* on the photosensitive drum 1*b* in the second image forming portion B, a distance Lc between the primary transfer positions T1*a*, T1*b* on the intermediate transfer belt 61, and a length Lm of image (hereinafter referred to as "image length") to be formed in the conveyance direction, satisfy the relation as follows:

$$Lc+Sa-Sb \geqq Lm \quad \text{[Formula 5].}$$

With the satisfaction of Formula 5, the secondary transfer roller 66 can do without contacting operation during the exposure operation.

[Eighth Embodiment]

Figure 9:
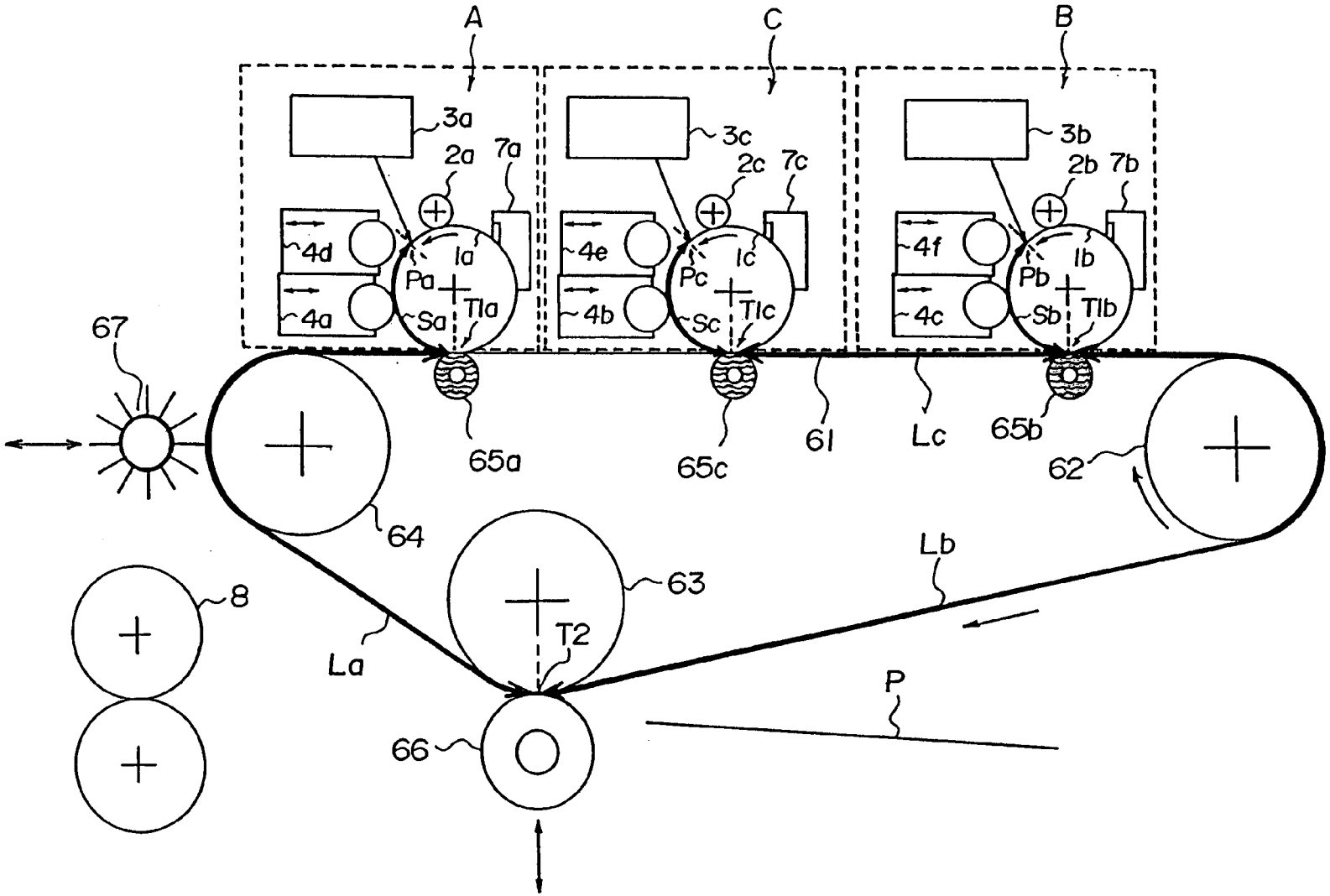
FIG. 9 is an illustration showing an image forming apparatus according to the eighth embodiment of the invention.
Figure 10:
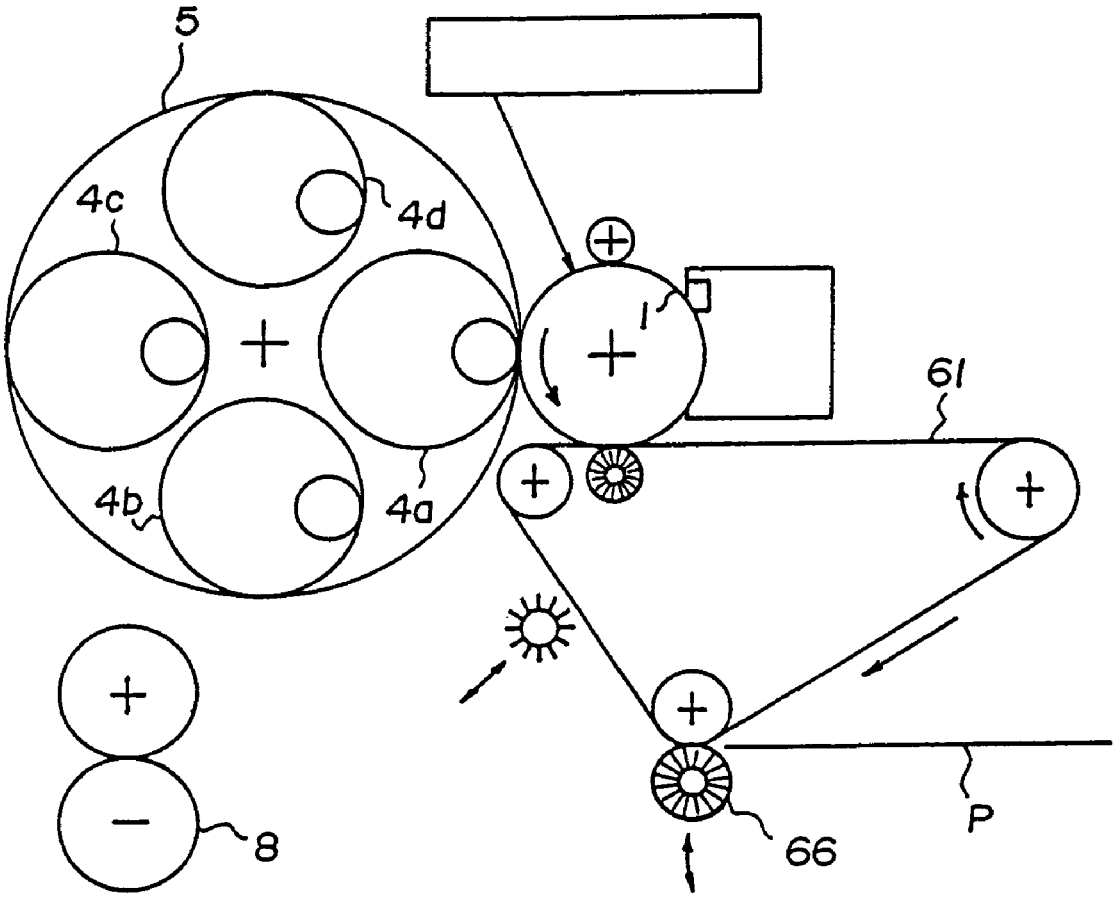
FIG.10 PRIOR ART
FIG. 10 is an illustration showing an image forming apparatus of a conventional one path type.

FIG. 9 is for the eighth embodiment of the invention. Members having the same structure and function as those in the first embodiment as described above are assigned with the corresponding reference numerals Sc, Pc, 1*c*, 2*c*, 3*c*, 7*c*, T1*c*, and 65*c*, respectively, and a description is omitted. In this embodiment, a mechanism having three image carriers is described. Recently, improvements on image quality are done by reducing particle feelings in images and increasing color range volumes using toners of four colors or more.

In this embodiment, exemplified is a mechanism that the toner colors are of six colors. The developing apparatuses 4*a*, 4*b*, 4*c*, 4*d* are including the toners substantially the same as those in the embodiments above, and developing apparatuses 4*e*, 4*f* are including light magenta, and light cyan, respectively.

The image forming portion having the first image carrier is set as A; the image forming portion having the second image carrier is set as B; the image forming portion having the third image carrier is set as C. The drive method of the intermediate transfer belt 61 and the detachably attaching operation of the secondary transfer roller 66 in this embodiment are following to the above embodiments. However, the image forming portion C containing the third image carrier is additionally formed, and it is added between the image forming portion A having the first image carrier and the image forming portion B having the second image carrier. To avoid mismatching to the first to sixth embodiments, the image forming portion C is provided at a space between the image forming portion A and the image forming portion B. This is because, in this Puncture of the embodiment, a distance largely affecting in relation to the secondary transfer roller 66 is of the image forming portion A and the image forming portion B. To regulate the relation to the length Lm of the transfer material with respect to the distance La between the transfer position of the image forming portion A and the secondary transfer roller 66 as well as the distance Lb between the transfer position of the image forming portion B and the secondary transfer roller 66, is one of the subject matters of the invention.

The image forming portion C forms a toner image to overlap, on the transfer belt 61, the toner image formed at the image forming portion A and to form the toner image formed at the image forming portion B thereon. Structures depicted by reference characters Sc, Pc, 1*c*, 2*c*, 3*c*, 7*c*, T1*c*, and 65*c* of image forming portion C correspond respectively to their counterpart structures Sa, Pa, 1*a*, 2*a*, 3*a*, 7*a*, T1*a*, and 65*a* of image forming portion A. By twice circulations of those toner images, a toner image overlapped by six colors of the toners is formed on the intermediate transfer belt 61.

As described above, according to the above embodiments, exposure blurs at the image forming portions caused by contacting shocks at the second transfer means can be prevented. Further, more compact and less costly apparatus can be provided.

Moreover, in the above described embodiments, though a printer is illustrated as an image forming apparatus, this present invention is not limited to it but can be adapted to other image forming apparatus such as a copy machine, a facsimile machine and so on or other image forming apparatus such as a compound machine combined with those functions and the same effect can be given by means of application of this invention to the image forming apparatus.

Also, various embodiments have been showed and described, but the subject matter and scope of this invention are not limited to particular descriptions nor figures in specification.

What is claimed is:

1. An image forming apparatus comprising:

a plurality of movable image carriers, said image carriers bearing latent images upon exposure at respective exposing positions to form a toner image from the latent images;

a movable intermediate transfer body, to which the toner image is transferred from said image carriers, for carrying the toner image; and a contacting member separably contacting said intermediate transfer body at a contacting position for transforming the toner image from said intermediate transfer body to a transfer material, wherein an image carrier located most closely to the contacting position in a direction extending along said intermediate transfer body on a downstream side in a moving direction of said intermediate transfer body with respect to the contacting position, constitutes a first image carrier where a position for transfer between said first image carrier and said intermediate transfer body constitutes a first transfer position, wherein said image carrier located most closely to the contacting position in a direction extending along said intermediate transfer body on an upstream side in a moving direction of said intermediate transfer body with respect to the contacting position, constitutes a second image carrier where a position for transfer between said second image carrier and said intermediate transfer body constitutes a second transfer position, wherein a toner image formed on said intermediate transfer body is transferred onto the transfer material after passing through the first transfer position and the second transfer position again, wherein a relationship La−Sa≧Lm is satisfied where a distance from the contacting position to the first transfer position along the moving direction of said intermediate transfer body is set as La, where a distance from the exposing position on the first image carrier to said first transfer position along the moving direction of said first image carrier is set as Sa, and where an image length formed on said intermediate transfer body is set as Lm, and wherein a latent image formation on said first image carrier is performed at a time different from a contacting operation of said contacting member.

2. The image forming apparatus according to claim 1, wherein said contacting member comprises a means for transferring the toner image from said intermediate transfer body to the transfer material.

3. The image forming apparatus according to claim 1, wherein said contacting member comprises a means for cleaning toner remaining after transfer of the toner image from the said intermediate transfer body to the transfer material.

4. The image forming apparatus according to claim 1, further comprising another contacting member to contact with said intermediate transfer body, said contacting member contacting with said intermediate transfer body nearer to the second transfer position than said another contacting member at a downstream side in a moving direction of said intermediate transfer body.

5. The image forming apparatus according to claim 1, the image length Lm formed on said intermediate transfer body is set as a longest image which the image forming apparatus can form on the intermediate transfer body.

6. An image forming apparatus comprising:

a plurality of movable image carriers, said image carriers bearing latent images upon exposure at respective exposing positions to form a toner image from the latent images;

a movable intermediate transfer body, to which the toner image is transferred from said image carriers, for carrying the toner image; and a contacting member separably contacting said intermediate transfer body at a contacting position for transferring the toner image from said intermediate transfer body to a transfer material, wherein an image carrier located most closely to the contacting position in a direction extending along said intermediate transfer body on a downstream side in a moving direction of said intermediate transfer body with respect to the contacting position, constitutes a first image carrier where a position for transfer between said first image carrier and said intermediate transfer body constitutes a first transfer position, wherein said image carrier located most closely to the contacting position in a direction extending along said intermediate transfer body on an upstream side in a moving direction of said intermediate transfer body with respect to the contacting position, constitutes a second image carrier where a position for transfer between said second image carrier and said intermediate transfer body constitutes a second transfer position, wherein a toner image formed on said intermediate transfer body is transferred onto the transfer material after passing through the first transfer position and the second transfer position again, wherein a relationship $Lb+Sb \geqq Lm$ is satisfied where a distance from the contacting position to the second transfer position along the moving route of said intermediate transfer body in a direction reverse to the moving direction of said intermediate transfer body is set as Lb, where a distance from the exposing position on said second image carrier to the second transfer position along the move of said second image carrier is set as Sb, and where an image length formed on said intermediate transfer body is set as Lm, and wherein a latent image formation on said second image carrier is performed at a time different from a contacting operation of said contacting member.

7. The image forming apparatus according to claim 6, wherein a relationship $Lb+Sb+La-Sa>Lm$ is satisfied where a distance from the contacting position to the first transfer position along the moving direction of said intermediate transfer body is set as La, and wherein a distance from the exposing position on said first image carrier to the first transfer position along the moving direction of said first image carrier is set as Sa.

8. The image forming apparatus according to claim 6, wherein a relationship $Lb+Sb+La-Sa<Lm$ is satisfied where a distance from the contacting position to the first transfer position along the moving direction of said intermediate transfer body is set as La, and where a distance from the exposing position on said first image carrier to the first transfer position along the moving direction of said first image carrier is set as Sa, and wherein a toner image formation position on the intermediate transfer body is moved on an upstream side with respect to the moving direction of said intermediate transfer body at each image formation where images are formed successively.

9. The image forming apparatus according to claim 6, the image length Lm formed on said intermediate transfer body is set as a longest image which the image forming apparatus can form on the intermediate transfer body.

10. An image forming apparatus comprising:

a plurality of movable image carriers, said image carriers bearing latent images upon exposure at respective exposing positions to form a toner image from the latent images;

a movable intermediate transfer body, to which the toner image is transferred from said image carriers, for carrying the toner image; and a contacting member separably contacting said intermediate transfer body, at a contact for transforming the toner image from said intermediate transfer body to a transfer material, wherein an image carrier located on an upstream side of said contacting member in a moving direction of said intermediate transfer body, among said plural image carriers, constitutes a first image carrier, whereas the image carrier located on a downstream side of said first image carrier in the moving direction of said intermediate transfer body, constitutes a second image carrier where a position for transfer between said first image carrier and said intermediate transfer body constitutes a first transfer position and where a position for transfer between said second image carrier and said intermediate transfer body constitutes a second transfer position, wherein a toner image formed on said intermediate transfer body is transferred onto the transfer material after passing through the first transfer position and the second transfer position again, wherein a relationship $Lc+Sa-Sb \geqq Lm$ is satisfied where a distance from said exposing position on said first image carrier to the first transfer position along the moving direction of said first image carrier is set as Sa, where a distance from the exposing position on said second image carrier to the second transfer position along the moving direction of said second image carrier is set as Sb, where a distance from the first transfer position to the second transfer position along the moving direction of the intermediate transfer body is set as Lc, and where an image length formed on said intermediate transfer body is set as Lm, and wherein a latent image formation on said first image carrier, a latent image formation on said second image carrier, and a contacting operation of said contacting member are performed at times different from each other.

11. The image forming apparatus according to claim 10, wherein said contacting member includes a means for cleaning toner remaining after transfer of the toner image from the said intermediate transfer body to the transfer material.

12. The image forming apparatus according to claim 10, wherein said contacting member includes a means for transferring the toner image from said intermediate transfer body to the transfer material.

13. The image forming apparatus according to claim 10, wherein the contacting operation of said contacting member is done after forming a latent image on the first image carrier and before forming a latent image on the second image carrier.

14. The image forming apparatus according to claim 10, the image length Lm formed on said intermediate transfer body is set as a longest image which the image forming apparatus can form on the intermediate transfer body.

* * * * *

UNITED STATES PATENT AND TRADEMARK OFFICE

CERTIFICATE OF CORRECTION

PATENT NO. : 7,085,524 B2
APPLICATION NO. : 10/721891
DATED : August 1, 2006
INVENTOR(S) : Takamitsu Soda et al.

It is certified that error appears in the above-identified patent and that said Letters Patent is hereby corrected as shown below:

COLUMN 2:
Line 4, “from formed” should read --from being formed--.
Line 7, “invention,.” should read --invention is,--.

COLUMN 4:
Line 48, “am” should read --are--.

COLUMN 5:
Line 10, “image” should read --images--.
Line 17, “roller 65b as” should read --roller 65b so as--.
Line 23, “come” should read --comes--.
Line 27, “come” should read --comes--.
Line 28, “em tone” should read --cyan toner--.
Line 30, “formed as” should read --formed so as--.
Line 31, “bet” should read --belt--.
Line 36, “belt 61 as” should read --belt 61 so as--.
Line 46, “a” should read --are--.
Line 49, “reining” should read --remaining--.
Line 55, “two-turns” should read --two turns--.

COLUMN 6:
Line 60, “hereinafter” should read --(hereinafter--.

COLUMN 7:
Line 6, “apparatus correspond” should read --apparatus to correspond--.
Line 27, “lager.” should read --larger--.
Line 41, “blushing” should read --brushing--.
Line 42, “blush” should read --brush--.
Line 59, “moving.” should read --movement.--

COLUMN 8:
Line 32, “satisfy the relation above” should read --satisfying the relation of above--
Line 61, “form” should read --from--.
Line 62, “angle é” should read --angle $\theta$--.

COLUMN 9:
Line 28, “liens” should read --lines--.
Line 38, “become” should read --becomes--.
Line 42, “become” should read --becomes--.
Line 43, “point á.” should read --point $\alpha$.--.
Line 45, “become” should read --becomes--.

UNITED STATES PATENT AND TRADEMARK OFFICE

CERTIFICATE OF CORRECTION

PATENT NO. : 7,085,524 B2
APPLICATION NO. : 10/721891
DATED : August 1, 2006
INVENTOR(S) : Takamitsu Soda et al.

It is certified that error appears in the above-identified patent and that said Letters Patent is hereby corrected as shown below:

COLUMN 10:
Line 8, “compacter” should read --more compact--.
Line 28, “does” should read --do--.
Line 32, “arm” should read --are--.
Line 41, “Age” should read --image--.
Line 45, “expose” should read --exposing--.
Line 61, “satisfy” should read --satisfying--.

COLUMN 11:
Line 23, “blushing” should read --brushing--.
Line 24, “blush” should read --brush--.
Line 41, “isolating moving.” should read --isolation movement.--.
Line 43, “cause” should read --caused--.
Line 48, “form” should read --from--.

COLUMN 12:
Line 33, “satisfy” should read --satisfying--.

COLUMN 14:
Line 31, “satisfy” should read --satisfying--.

COLUMN 15:
Line 2, “Puncture” should read --structure--.
Line 19, “twice” should read --two--.
Line 36, “showed” should read --shown--.

COLUMN 17:
Line 12, “move” should read --moving direction--.

UNITED STATES PATENT AND TRADEMARK OFFICE

CERTIFICATE OF CORRECTION

PATENT NO. : 7,085,524 B2
APPLICATION NO. : 10/721891
DATED : August 1, 2006
INVENTOR(S) : Takamitsu Soda et al.

It is certified that error appears in the above-identified patent and that said Letters Patent is hereby corrected as shown below:

COLUMN 18:
Line 37, "the" (second occurrence) should be deleted.

Signed and Sealed this

Fifteenth Day of May, 2007

JON W. DUDAS
*Director of the United States Patent and Trademark Office*